United States Patent [19]

Dewas

[11] 4,423,756

[45] Jan. 3, 1984

[54] WEFT INSERTER FOR WEAVING MACHINES

[76] Inventor: Raymond Dewas, 120, Boulevard de Quentin, Saint 8000 Amiens, France

[21] Appl. No.: 368,978

[22] Filed: Apr. 16, 1982

[30] Foreign Application Priority Data

Jan. 31, 1979 [FR] France ..... 79 02554

[51] Int. Cl.[3] ..... D03D 47/20

[52] U.S. Cl. ..... 139/448

[58] Field of Search ..... 139/447, 448

[56] References Cited

U.S. PATENT DOCUMENTS

| | | | |
|---|---|---|---|
| 2,192,728 | 3/1940 | Dewas | 139/448 |
| 3,580,291 | 5/1971 | Piccoli | 139/448 |
| 3,719,211 | 3/1973 | Porter | 139/448 |

FOREIGN PATENT DOCUMENTS

| | | | |
|---|---|---|---|
| 742498 | 6/1980 | U.S.S.R. | 139/448 |

*Primary Examiner*—Henry Jaudon

*Attorney, Agent, or Firm*—Peter L. Berger

[57] ABSTRACT

A weft inserter for weaving machines wherein the weft supply is provided from a stationary package located outside the shed including a hand and a weft gripper having a rigid lower portion and a resilient upper portion. Ramp guiding means are provided for guiding the weft into an angle over a center ramp having a finger that bears downward upon the resilient upper portion of the gripper with the result that when tension increases in the weft, at least a portion of the increased tension is transmitted to the weft gripper in the gripping direction.

6 Claims, 8 Drawing Figures

WEFT INSERTER FOR WEAVING MACHINES

BACKGROUND OF THE INVENTION

This invention relates to weaving machines wherein the weft supply is provided from stationary packages located outside the shed. Specifically, the present invention relates to improvements to the weft inserters of the type of weaving machines noted.

It is known in the art that in such weaving machines, the weft, which is provided by at least one package, is presented to a weft feed inserter outside the shed and thereupon seized by the inserter, which in turn transports it by its free end inside the shed. The inserter either continues to carry the weft to the other side of the shed or, more often, transfers the weft to a secondary pulling inserter that operates in opposition phase from the other side of the shed.

The seizing, holding, and disengagement operations on the weft by the inserter are carried out in a resilient fashion. In particular, the front end of the inserter is provided with a gripper having at least one resilient portion and which, when non-operative, is in a closed position.

During the gripping, or seizing operation, the weft is presented to the feed inserter in a manner known in the art on the path of travel of the inserter until it penetrates into the gripper. The holding of the weft during the insertion in the shed is accomplished by the resilient gripping action of the gripper on the weft. The disengagement operation on the weft is carried out by an external action applied to the weft and/or by a controlled opening operation on the gripper, for example, by a disengagement blade that drives between the two opposing portions of the gripper.

For ensuring a sufficient hold on the weft by the gripper, the gripper must at least provide a minimum resilient gripping force having a given value; the gripping force, however, must have a maximum value in order to allow the primary feed inserter, after the taking up of the weft by way of deformation of the opposing portions of the gripper to disengage the weft for transfer to the gripper of the secondary pulling inserter. That is, the force exerted by the gripper on the weft must have both a minimum value that allows a normal hold on the weft and a maximum value that allows the transfer of the weft from the primary inserter to the secondary inserter.

In the present state of the art, the gripping force provided by inserter grippers is between the extreme limits as defined above.

If there is, however, an inadvertent over-tensioning of the weft during the insertion operation, for example because of an irregularity of the yarn of a fault in the package, the holding force applied on the weft by the gripper may be insufficient. In such an event, the weft becomes disengaged, thereby causing a stoppage of the machine in order to remove the faulty weft.

If, in order to avoid such incidents, the gripping force of the gripper is increased, there is a risk that the weft will not be able to penetrate between the gripping portions of the gripper and thus will not be correctly seized.

BRIEF DESCRIPTION OF THE INVENTION

An object of the present invention is to avoid the disadvantages of the present art and to provide an improved insertion having a gripper in which the gripping force applied to the weft is established to an extent as a function of the weft tension.

In order to accomplish this object, the inserter according to this invention comprises a rigid head and first, second and third weft ramps on said head positioned in approximate parallel relationship. The second ramp is located between the first and third ramps. The first, second, and third ramps have respective first, second, and third ramp front portions, or tips, the first and third tips being positioned at an elevation above said second ramp tip. The first and the third ramps are downwardly inclined and the second ramp is upwardly inclined relative to their respective tips and to the head. The second weft ramp includes a first weft guiding position and the third weft ramp includes a second weft guiding position. The invention further includes a resilient weft gripping means including a resilient first weft ramp, the gripping means being formed by the converging lower surface of the first weft ramp and the upper surface of a lower member maintained on the head. The weft is movable relative to the moving inserter from a first weft position to a second weft position. The first, second, and third weft ramps define a weft seizing and directing means for seizing the weft in the first position wherein the weft is maintained transverse to the movement of the inserter at an elevation below the first and third ramp tips and above the second ramp tip; and for directing the weft downward under the first and third ramps and upward over the second weft ramp to a position of seizure by said gripper and to said first and second weft guiding positions wherein the weft ceases movement relative to the inserter and is positioned in a state of tension by said inserter. In accordance with the invention, a novel feature includes a resilient second ramp which includes an element capable of resiliently bearing downwards on the upper surface of said first weft ramp, whereby when the weft is in the second weft position in the state of tension, the element bears, or is borne, downward upon the first weft ramp and partially transmits the force of the tension against the first ramp and in turn against the weft in the gripper.

The invention will be more clearly understood from the following description and with reference to the following drawings wherein.

DETAILED DESCRIPTION OF THE PREFERRED EMBODIMENT

Figure 1:
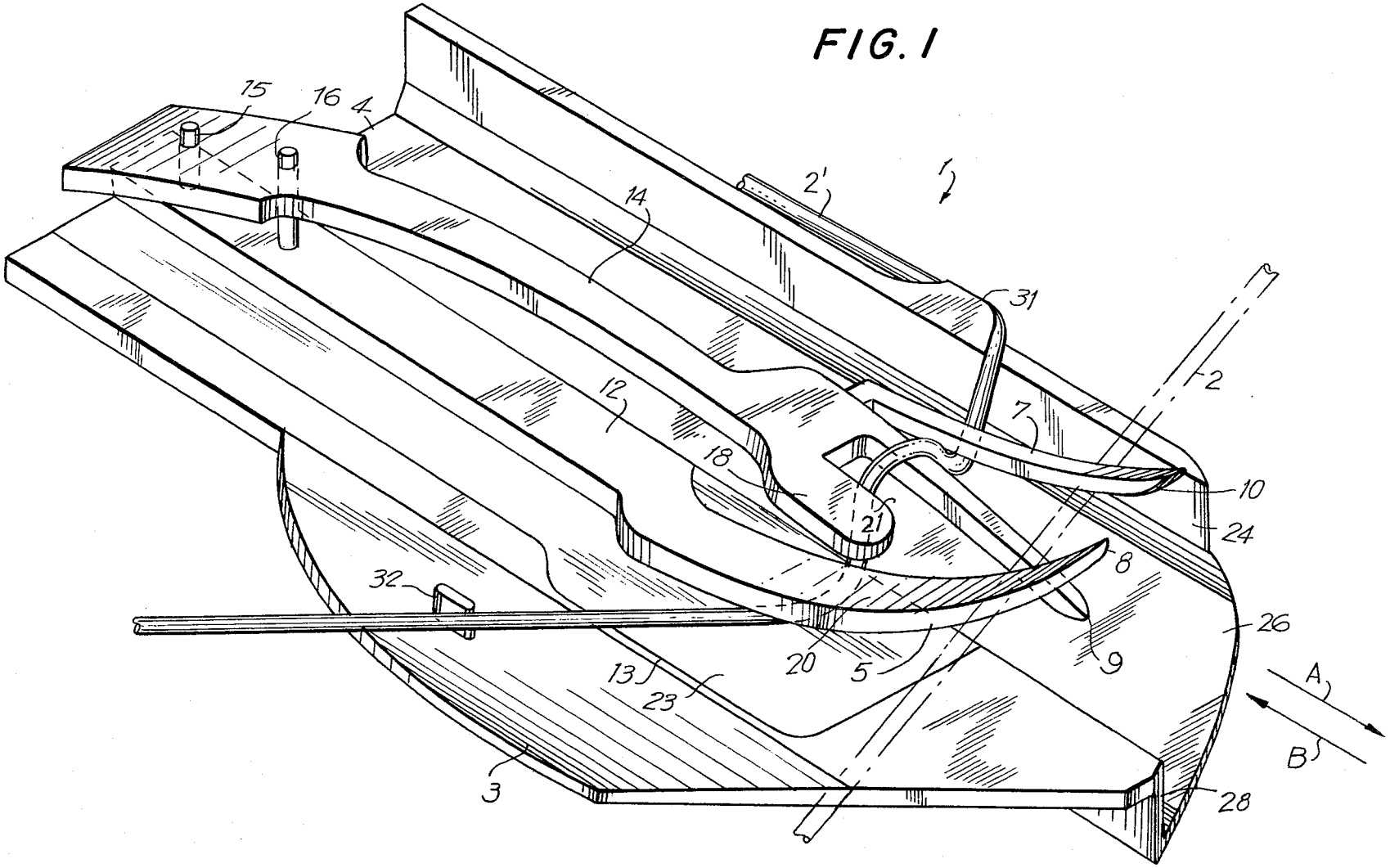
FIG. 1 is a three dimensional view of the primary feed inserter according to the present invention.
Figure 2:
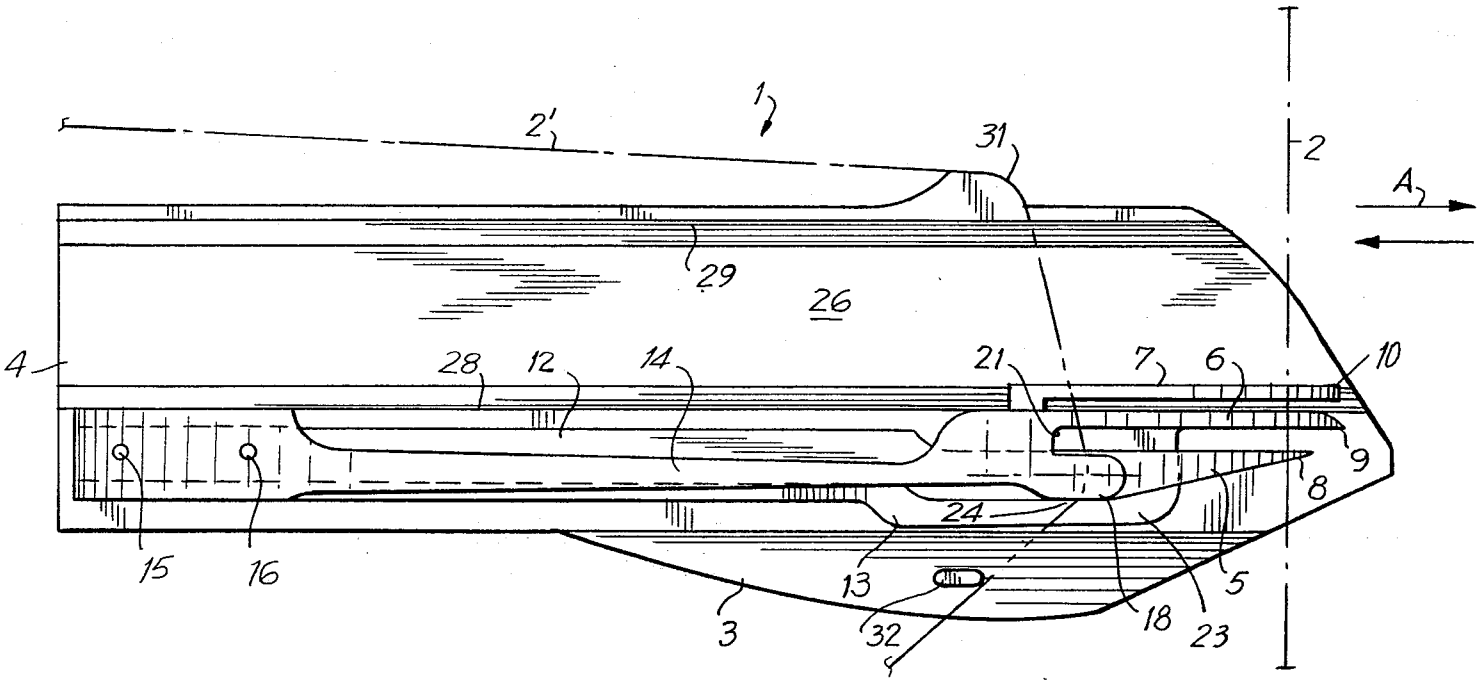
FIG. 2 is a plan view of the primary feed inserter according to the invention.
Figure 3:
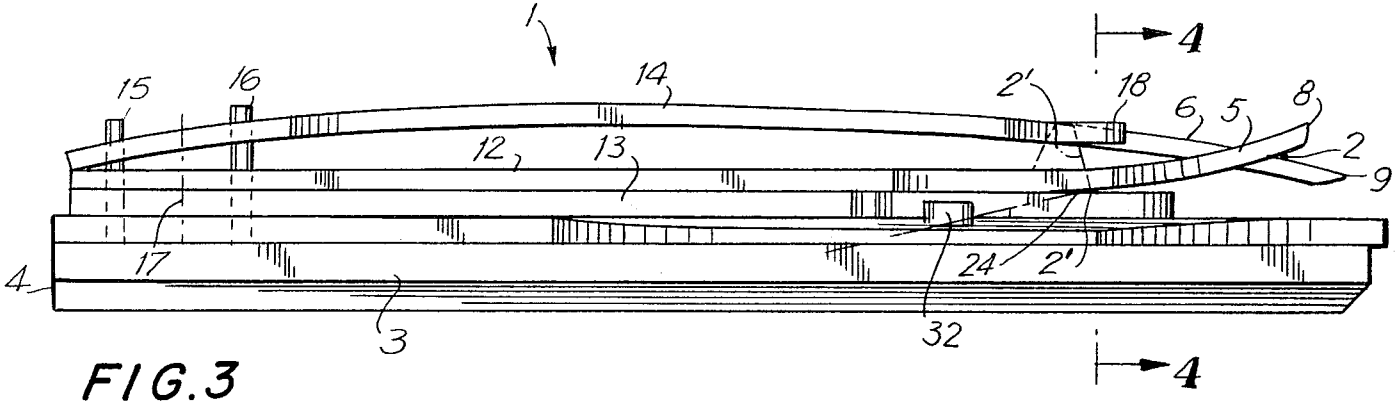
FIG. 3 is a side elevational view of the inserter of FIG. 2.
Figure 4:
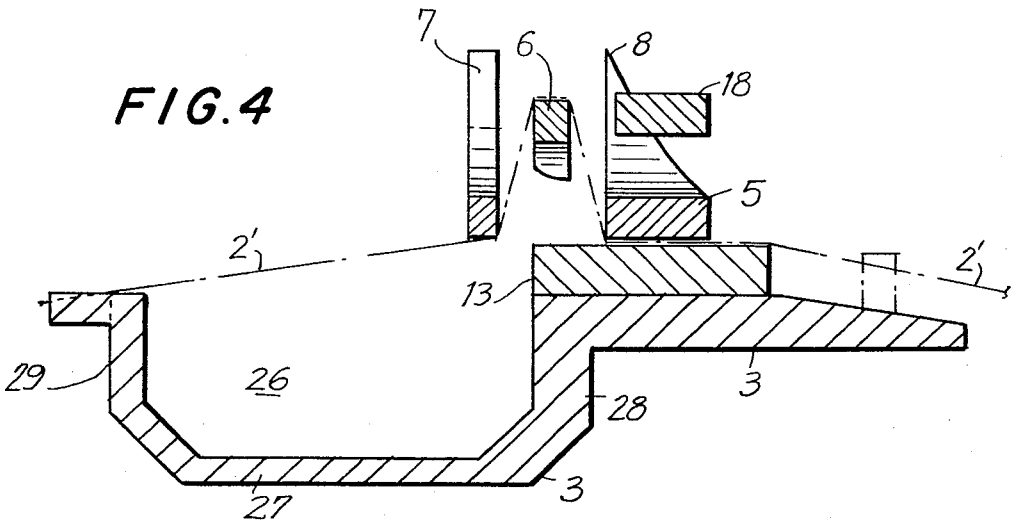
FIG. 4 is a sectional view along lines 4—4 of FIG. 2.

Reference is now made in greater detail to the drawings:

A weft inserter 1 is illustrated in perspective in FIG. 1 and in plan, side, and sectional views in FIGS. 2, 3 and 4, respectively. As illustrated, FIGS. 1–4 show a simplified rendering of a preferred embodiment of the invention. Inserter 1 is a primary feed type inserter. Feed inserter 1 receives a stationary tensioned weft yarn 2 provided from a stationary package (not shown) positioned outside the shed (not shown) and thereupon transports yarn 2 inside the shed, either to the opposite side of the shed, or to a secondary pulling inserter to be described later. As is well-known in the art, the shed is formed by upper and lower sheets of warp yarns.

Inserter 1 includes a rigid head, or housing having upper and lower sections. For purposes of clarity of pictoral representation, the upper section of the housing has been removed and only the lower section of the housing, labeled as numeral 3 is shown. Rear portion 4 of housing 3 is mounted on a needle body (not shown); the needle body in turn is driven by a perforated flexible driving ribbon.

Tensioned weft 2 is shown both in its initial position as it is mounted transverse to the movement of inserter 1 outside the shed and in a second position labeled as 2' where it has been moved to a stationary position relative to the moving inserter 1 from its first position but where in fact it is being moved in direction A relative to the shed.

As feed inserter 1 moves in direction A toward weft 2, the weft is seized by inserter 1 in a manner to be described and directed to a non-moving position relative to inserter 1 in a state of tension Inserter 1 includes first weft ramp 5, second weft ramp 6, and third weft ramp 7 all positioned on housing 3 in approximately parallel relationship. Ramps 5, 6, and 7 include first, second, and third tip portions 8, 9 and 10, respectively. First and third ramps 5 and 7 are downwardly inclined relative to housing bottom 3 and second ramp 6 is upwardly inclined relative to housing bottom 3. First weft ramp 5 is formed as a part of elongated lower mounting member 12, while in turn is attached to a rigid plate member 13, which in turn is attached to housing bottom 3. Second weft ramp 6 is formed as a part of elongated upper member 14, which is resiliently and slidably connected to lower member 12 in a known manner via pins 15 and 16, which in turn are preferably attached to base plate 13.

According to the present invention, upper member 14 forks at its forward end into second weft ramp 6 and pressing extension or finger, 18; second weft ramp 6 and finger 18 form the forward portion of upper elongated member 14, which is resiliently movable upwardly or downwardly within a range of movement as dictated in a known manner by pins 15 and 16 shown schematically in FIGS. 2 and 3. Pin 17 shown schematically in FIG. 3 fastens plate 13 to housing 3. In its normal position, finger 18 is preferably in touching contact with the forward end of lower resilient member 12 specifically at upper surface 20 of first weft ramp 5. Second weft ramp 6 and finger 18 form prong gap 21 between them. As stated, first weft ramp 5 has a resilient range of movement. Lower surface 22 of first weft ramp 5 and upper surface 23 of base member 13 form weft gripper 24 between them. Gripper 24 is resilient because of the resilient capability of first weft ramp 5, which in turn is capable of movement toward base plate 13. Finger 18 when pressured downwardly against upper surface 20 of first ramp 5 causes first ramp 5 in turn to move toward base member 13. When the pressure against first ramp 5 is removed, ramp 5 will resiliently move upwardly. Likewise, when the pressure against finger 18 is removed, the forward portion of upper member 14 will likewise resiliently move upwardly to assume its former position. Thus, the forward portions of both upper and lower members 12 and 14 are biasable between normal upward positions and biased downward positions. References herein to the forward portion of lower member and first weft ramp 5 are interchangeable. Gripper 24 is formed between the rear area of first ramp 5, which, as stated, form the forward area of lower member 12.

The base of third weft ramp 7, which is preferably an elongated ramped finger, is preferably connected to base plate 13 as shown in FIG. 2, although it can be alternatively connected to the side of upper member 14 at the rear area of second ramp 6. As indicated previously, front portions 8 and 10 of first and third ramps 5, 7 are positioned at elevations above weft 2 and front portion 9 is positioned at an elevation below weft 2. First and third weft ramps 5 and 7 including their front portions or tips 8 and 10 are preferably positioned at the same elevations and have the same profiles when viewed from the side, so that first weft ramp 5 blocks out third weft ramp 7 in the side elevation of FIG. 3 .

Lower housing 3 forms a longitudinal, elongated recess, or channel 26 adjacent to third weft range 7 and which runs approximately parallel to the direction of the three weft ramps and upper and lower mounting members 12 and 14. Channel 26 is capable of receiving and guiding the secondary pulling inserter to be described below. Channel 26 is formed only in those feed inserters that transfer the weft to a pulling inserter. Such a feed inserter is illustrated and discussed here as the preferred embodiment for purposes of illustration only, and it is to be understood the invention is not to be limited to such a type of feed inserter as here expounded upon. Channel 26 is formed by flat bottom wall 27, uprighted side wall 28 positioned adjacent to base member 13, and upright far side wall 29, which stands independently. Weft support, or guide, post 31 is positioned on the top of far wall 29 for a purpose to be described below. Weft cutting blade 32 is preferably mounted on lower housing section 3 distanced from first weft ramp 5. Post 31 and blade 32 are positioned on opposite sides of the three weft ramps at positions approximately opposite one another relative to the weft ramps.

In operation, a weft 2, stationary relative to the shed, is presented to the inserter 1 moving from outside the shed on a path of travel indicated by arrow A in FIGS. 1 and 2. Weft 2 is positioned initially transverse to the path of movement of feed inserter 1 at an elevation below first and third ramp front portions 8 and 10 and above second ramp front portion 9. Weft 2 is seized by the ramp front portions and is then directed downwards under first and third ramps 5 and 7 and upwardly over second weft ramp 6. As the inserter continues to move in direction A, weft 2, which moves from its first stationary position relative to inserter 1 assumes a second position relative to the inserter where it is stationary relative to the moving inserter and moving relative to the shed. This second position is shown as weft 2' in FIGS. 1, 2, 3 and 4. Weft 2' has slid into resilient gripper 24 between plate 13 and lower surface 22 of first weft ramp 5. Simultaneously, weft 2' has moved upward to a final position at the top of second ramp 6 from where it extends downwardly on either side. On one side it extends downward through gap 21 to gripper 24 and on the other side downward to a point under third weft ramp 7. From ramp 7 weft 2' extends horizontally across recess 26 to guide post 31, from where the weft extends to the weft package (not shown) alongside and outside the inserter. On the opposite side weft 2' extends from gripper 24 to cutting blade 32. Thus, the weft is resiliently gripped at gripper 24 and guided at its positions at the top of second ramp 6, the bottom of third ramp 7, and guide post 31, which act as first, second, and third guiding posts, or means, respectively, for the weft as weft 2' in its final position prior to being cut at blade 32. First, second, and third weft ramps 5, 6 and 7 including their front portions, or tips, 8, 9 and 10, act as weft seizing and guiding means whereby stationary weft 2 is seized by the moving inserter between the front portions of the ramps and thereupon guided by the weft ramps to final seized positions In accordance with the present invention, weft 2', which is in a state of tension in its second position because of its seizure at gripper 24 and the weft guiding points, exerts a downward bearing force on resilient finger 18. Weft 2' forms an angle downwards from each side of its second position at the top of second ramp 6 to gripper 5 and to the undersurface of third ramp 7. At least a part of the bearing force exerted by weft 2' downward at finger 18 in turn bears finger 18 downward against upper surface 20 of first weft ramp 5. Since ramp 5 is the upper gripping portion of gripper 24 and is also resiliently movable, it bears downwardly on weft 2' which has been seized between the first ramp and base plate 13. The direction of the bearing force on finger 18 by weft 2' is the direction of the inner bisectrix of the weft angle formed by weft 2' as it extends downwardly on either side of its second position on second ramp 6. The amplitude of the force exerted by weft 2' at its first guide position on second ramp 6 is dependent on the amount of tension in weft 2' and also on the measure of the angle formed by weft 2'. For a definite measure of the angle, the force is directly proportional to the tension in weft 2'. The bisectrix of the weft angle can besides being parallel to the force exerted by the weft at finger 18 be inclined relative to the direction of that force, since the gripper and the second guide position may be positioned at different distances from the first guide position.

It is apparent that if there is an inadvertent increase in tension of weft 2' in its second position, for example, because of an over-thickness defect in the weft or a fault in the package, the downward pressure exerted by the weft at its first guide position, and thus the downward pressure exerted by the weft on finger 18, increases and the gripping pressure exerted by gripper 24 also increases. The inventive feature of finger 18 provides gripper 24 with a moderate initial downward gripping pressure that is sufficient in normal operation and also provides an immediate increase in pressure on gripper 24 if the weft tension increases, thereby avoiding disengagement of the weft from the gripper.

As feed inserter 1 continues in direction A, weft 2' is cut by blade 32 carried by the inserter.

Recess 26, as described, is adapted to slidingly receive a second pulling inserter in a manner known in the art. As described, third weft ramp 7 and weft guide post 31 are on opposite sides of recess 26. The second pulling inserter moves in a direction opposite to direction A of feed inserter 1 and takes up the weft extending across recess 26 in order to transfer it to the other selvedge, thus completing the inserting operation.

Figure 5:
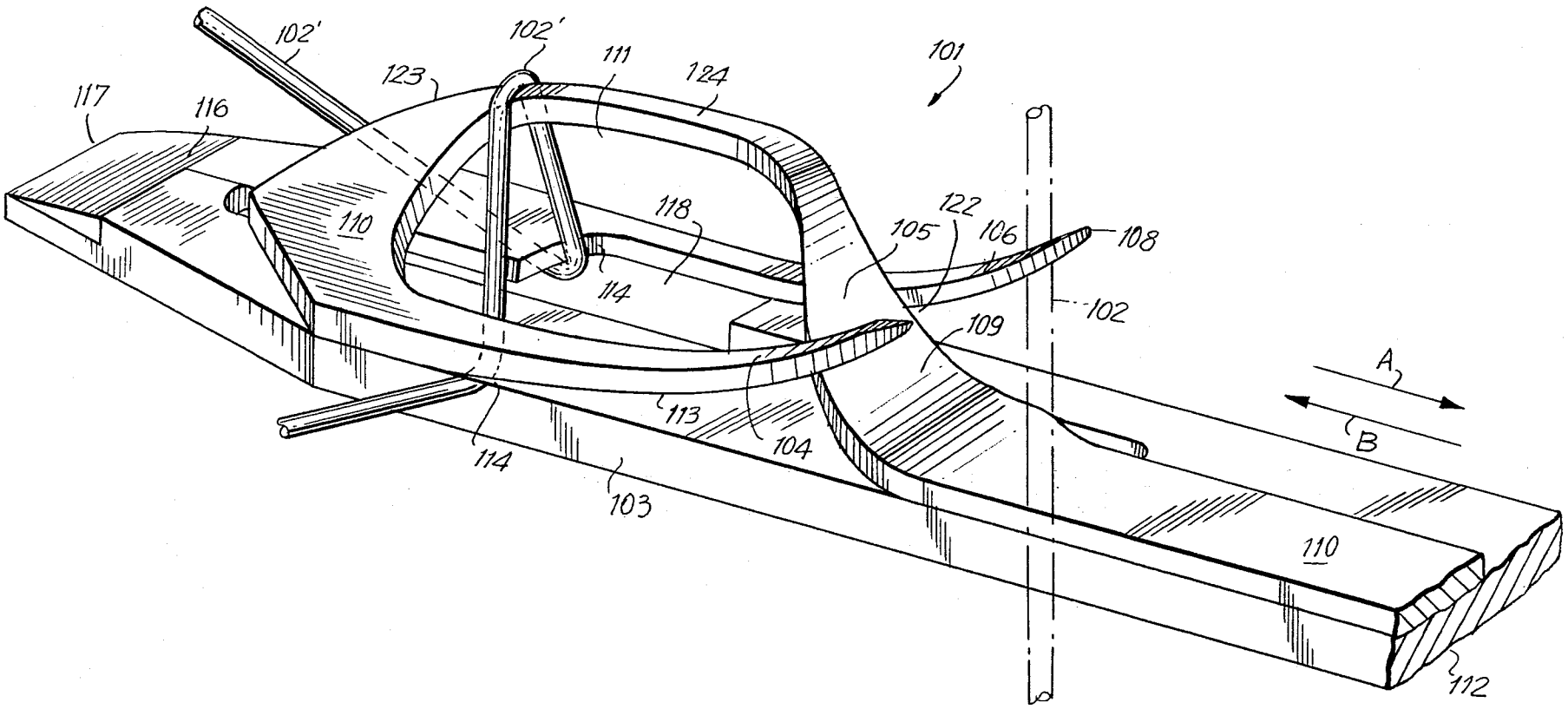
FIG. 5 is a perspective view of the secondary pulling inserter according to the present invention.
Figure 8:
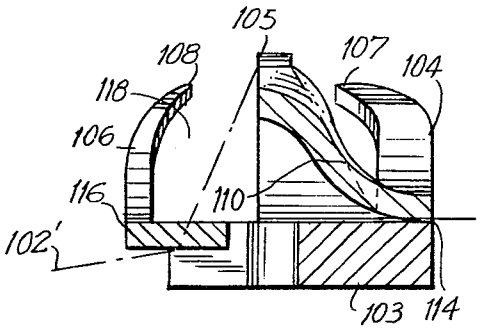
FIG. 8 is a sectional view taken along line 8—8 of FIG. 6.
Figure 6:
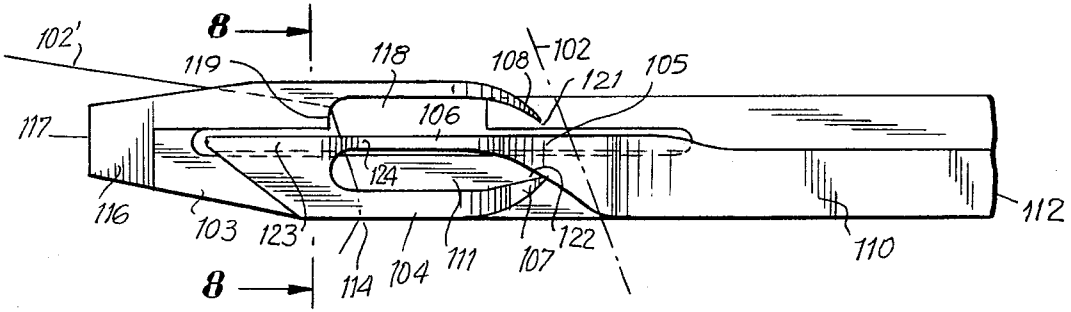
FIG. 6 is a plan view of the secondary pulling inserter according to the present invention.
Figure 7:
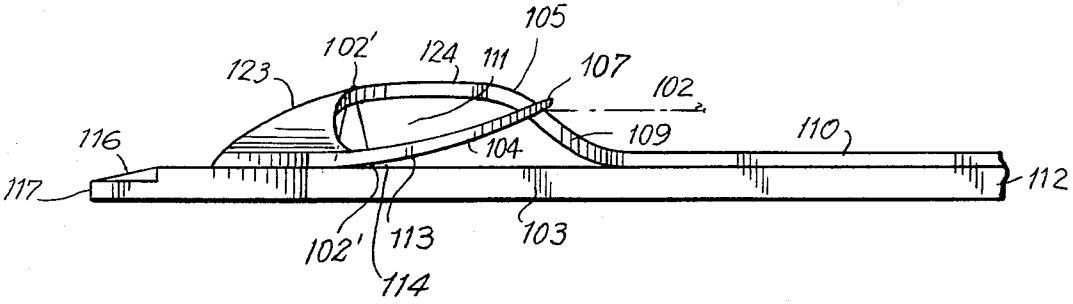
FIG. 7 is a side elevation view of the inserter of FIG. 6.

An arrangement of the second pulling inserter according to this present invention is illustrated in a preferred embodiment in perspective in FIG. 5 and in plan, side, and cross-sectional views in FIGS. 6, 7, and 8, respectively.

In particular, pulling inserter 101 is shown intercepting weft yarn 2' from feed inserter 1. Weft yarn 2' is designated as weft 102 in FIGS. 5–8. Pulling inserter 101 as shown is moving in direction A as was feed inserter 1 in order to intercept the yarn. Pulling inserter is adapted to be slidingly received in elongated recess 26 formed in feed inserter 1 as illustrated in FIGS. 1, 2, and 4. Inserter 101 includes a base 103 and first, second, and third weft ramps 104, 105, and 106, respectively. Second and third weft ramps 105 and 106 are preferably formed of one piece 110 that is connected to the top of base 103 as is best shown in FIGS. 5 and 6. First, second, and third weft ramps 104, 105, and 106 are analagous in operation to first, second, and third weft ramps 5, 6, and 7 of feed inserter 1. FIGS. 5–8 show pulling inserter 101 oriented similarly to feed inserter 1. Inserters 1 and 101 operate together but in phase opposition. Thus, the term forward as applied to inserter 101 is used to designate the right side of FIG. 5, although the forward movement of inserter 101 is to the left. An area 112 in front of inserter 101 is forward of first, second, and third ramps 104, 105, and 106. Pulling inserter 101 is slidingly mounted in recess 26 so that it can move either in direction A or in opposite direction B. When moving in direction A, the cut weft 2' stretched across the recess of inserter 1 is picked up by the weft ramps 104, 105, and 106. First and third weft ramps 104 and 106 have front portions or tips 107 and 108, respectively. Second weft ramp 105 located between ramps 104 and 106 has a front portion 109 that is part of single piece 110. Analagous to feed inserter 1, first, second, and third ramps 104, 105, and 106 define a weft seizing and directing means for seizing weft 102 in its transverse position mounted transversely across recess 26. First and third ramps 104 and 106 are downwardly inclined relative to base 103 and ramp 105 is upwardly inclined relative to base 103. Front portions 107 and 108 are positioned at elevations above weft 102 and front portion 109 is at an elevation below weft 102. First and third weft ramps 104 and 106 including their front portions or tips 107 and 108 are preferably positioned at the same elevations and have the same profiles when viewed from the side, so that first weft ramp 104 blocks out third weft ramp 106 in the side elevation of FIG. 7.

Both first weft ramp 104 and second weft ramp 105 are formed of one piece member 110 and an open "C" portion 111 is formed facing forward with respect to pulling inserter 101. "C" portion includes an upper leg segment 124 tapered rearwardly as at ramp 123 toward the base of the "C". "C" portion 111 functions both to receive weft 102' and to stop its movement at the base of the "C".

First weft ramp 104 is resilient and has undersurface 113 which meets base 103 to form resilient weft gripper 114. First weft ramp 104 at the area where it leaves its connections to base 103 forms the resilient upper portion of gripper 104 and base 103 forms the rigid lower portion of gripper 114.

Third weft ramp 106 is preferably formed of a second piece 116 which is fitted to the rear 117 of inserter 101 as can be seen in FIGS. 5 and 6. Second piece 116 forms a receiving aperture 118 for the weft at the level of base 103 and includes stop portion 119 for the weft located at the rear of the aperture. Weft passages 121 and 122 are positioned between first and second weft ramps 104, 105 and between second and third weft ramps 105 and 106 to allow free passage of weft 102 to "C" portion 111 and aperture 118, respectively.

In operation, pulling inserter 101 first moves in a direction B opposite direction A of feed inserter 1 so that weft 2' meets ramps 123. Weft 2' is raised upwardly over top 124 of piece 110 and then downwardly over second ramp 105. Simultaneously, weft 2' is then raised upwardly over first and third ramps 104 and 106 until it passes beyond tips 107 and 108 and then falls once again transverse to recess 26 below tips 107 and 108 and assumes the position designated as weft 102 in FIGS. 5–8. At this time the direction of movement of inserter 101 reverses from direction B to direction A.

At this time, when the operative direction of pulling inserter 101 is reversed to direction A (and feed inserter 1 likewise reverses from direction A to direction B), pulling inserter 101 proceeds to act to take up weft 102. Weft 102 is simultaneously raised upward on second weft ramp 105 and is pressed downward under first and third ramps 104 and 106. Weft 102 penetrates into gripper 114, into "C" portion 111, and into aperture 118. Movement of weft 102 is stopped by gripper 114 and stop portion 119 of aperture 118 so that it assumes the position designated as weft 102' in FIGS. 5–8. The pressure exerted by gripper 24 of feed inserter 1 is sufficiently low enough to allow the penetration of weft 102' into gripper 114 of pulling inserter 101 and subsequent transfer of weft 102' (weft 2') from gripper 24. After this exchange, weft 102' (weft 2') is totally disengaged from feed inserter 1 and is then held only by pulling inserter 101, which operation completes the insertion to the other side of the shed.

It is apparent from the foregoing description of the present invention that it is possible to remedy inadvertent overtensions of the weft in the feed inserter without having to provide the feed gripper with a high initial pressure.

The embodiment of the invention particularly described here is presented merely as an example of the invention. Other embodiments, forms, and modifications of the invention coming within the proper scope of the appended claims will, of course, readily suggest themselves to those skilled in the art. For example, pulling inserter 101 can include certain features of feed inserter 1 including finger 18 of second weft ramp 6 pressing upon resilient first weft ramp 5 so as to increase gripper pressure on the weft during increase of weft tension.

What is claimed is:

1. A moving weft inserter for a weaving machine including a stationary weft tensioned transverse to the path of the moving inserter, said inserter comprising:

a rigid head, first, second, and third weft ramps on said head positioned in approximate parallel relationship, said second ramp being located between said first and third ramps, said first, second, and third ramps having respective first, second, and third ramp tips, said first and third ramp tips being positioned at an elevation above said second ramp tip, said first and third ramps being downwardly inclined and said second ramp being upwardly inclined relative to said respective tips and to said head, said second weft ramp including a first weft guiding portion and said third weft ramp including a second weft guiding portion, and resilient weft gripping means including a resilient first weft ramp, said gripping means being formed by the converging lower surface of said first weft ramp and the upper surface of a rigid lower member mounted on said head, said weft being movable relative to said moving inserter from a first weft position to a second weft position, said first, second, and third weft ramps defining a weft seizing and directing means for seizing said weft in said first weft position wherein said weft is mounted transverse to the movement of said inserter at an elevation below said first and third ramp tips and above said second ramp tip, and for directing said weft downward under said first and third ramps and upward over said second weft ramp to a position of seizure by said gripping means and to said first and second guiding portions wherein said weft ceases movement relative to said inserter and is positioned in a state of tension by said inserter.

2. A weft inserter as claimed in claim 1, wherein said second weft ramp is resilient and includes an element capable of resiliently bearing downward on the upper surface of said first weft ramp, whereby when said weft is in said second weft position in said state of tension, said element bears downward upon said first weft ramp and partially transmits the force of said tension against said first ramp and in turn against said weft in said gripper.

3. A weft inserter as claimed in claim 2, wherein said weft in said second weft position extends downwardly from both sides of said first guiding portion to said gripper and to said second guiding portion and forming a weft angle, the bisectrix of said angle being parallel to the direction of said force of said tension against said first ramp.

4. A weft inserter as claimed in claim 3, wherein said bisectrix is inclined relative to the direction of said force against said gripper.

5. The weft inserter as claimed in claim 4, wherein said inserter is a feed type inserter having a longitudinal recess for the reception of a pull type inserter and further having a third weft guiding means, said gripper and said first and second guiding portions being located on one side of said recess and said third guiding portion being located on the opposite side of said recess, said weft being positioned transversely across said recess to said third guiding portion from said second guiding portion when in said second weft position.

6. The weft inserter as claimed in claim 4, wherein said inserter is a pulling type inserter.

* * * * *